US005666974A

United States Patent [19]

Hiro et al.

[11] Patent Number: 5,666,974

[45] Date of Patent: Sep. 16, 1997

[54] PROTOTYPE OF MOUTH PIECE

[75] Inventors: Takumitsu Hiro, 20-2-308, Higashiterao 5-chome, Tsurumi-ku, Yokohama-shi, Kamagawa-ken; Akinori Watanabe, Tokyo, both of Japan

[73] Assignees: Okamoto Industries, Inc., Tokyo; Takumitsu Hiro, Yokohama, both of Japan

[21] Appl. No.: 640,138

[22] Filed: Apr. 30, 1996

[51] Int. Cl.[6] ..... A61C 5/14

[52] U.S. Cl. ..... 128/861; 128/862

[58] Field of Search ..... 128/848, 859–862; 2/2

[56] References Cited

U.S. PATENT DOCUMENTS

| | | | |
|---|---|---|---|
| 2,669,988 | 2/1954 | Carpenter | 128/861 |
| 2,750,941 | 6/1956 | Cathcart | 128/862 |
| 2,833,278 | 5/1958 | Ross | 128/862 |
| 5,462,066 | 10/1995 | Snyder | 128/861 |

*Primary Examiner*—Michael A. Brown

*Attorney, Agent, or Firm*—Sherman and Shalloway

[57] ABSTRACT

This invention relates a prototype of a mouth piece characterized as having "H" shaped cross sectional view which is composed of an intermediate web member, outer wall and inner wall and can be loosely installed to dental arch of both maxilla teeth and mandibular teeth.

8 Claims, 1 Drawing Sheet

PROTOTYPE OF MOUTH PIECE

BACKGROUND OF THE INVENTION

This invention relates a prototype of mouth piece which is used to protect a jaw bone, teeth and an oral cavity of an athlete on training or on matching by clenching it so as to lighten the load to root of teeth, to prevent the occlusive injury and to improve the dynamic and static exercise ability of the athlete.

DESCRIPTION OF PRIOR ART

Generally, sport players of boxing or football who contact roughly with other players use mouth pieces during match or game to prevent the breaking of jaw bone or bursting of soft oral cavity. Moreover, mouth pieces are used for the purpose to lighten the load to root of teeth and to improve the skill and power of sport player.

Usually, a mouth piece is produced individually by dentist by adjusting it to a dental arch of an individual user. However, since the mouth piece produced by said procedure is very expensive, the users are limited to the special sport players. On the other hand, cheap mouth pieces composed by rubber elastic solid adjusted to a standard dental arch are now on the market, but it difficult to comfortably fit it to a dental arch of an individual user. That is, they have problems of inconvenience for actual use e.g. the user feels incompatibility for using and impediment for breathing.

To solve the above mentioned problems, the prototype of mouth piece of a size to be loosely fitted to a maxilla teeth of standard dental arch and of which outer wall, intermediate web and inner wall is produced so as to form one solid body having "U" shaped cross sectional view is disclosed (for example, Japanese Laid-open publication H3-57790). Before actual use of this prototype, room temperature hardening plugging paste layer is spreaded on the prototype and put it on maxilla teeth of the user and the plugging layer is clenched by mandibular teeth so as to fit the plugging layer to maxilla teeth, then the plugging layer is hardened and this is used as the mouth piece. This mouth piece is adjusted to the dental arch of each user and so it has a possibility of easily use and can be produced at lower price. However, in the preparation process of this mouth piece it is necessary to roughen the inner surface of the prototype because the plugging layer must be sticked strongly with it. And also the problem of stifling or oxygen taking (amount of oxygen taking in) is not solved. On the other hand, the method to improve an ability of a sport player by putting templates made of hard rubber composition on his molars is well-known, but the template does not have a function to protect the teeth.

Conventional mouth piece including said prototype mouth piece are produced so that to the cross sectional view of them forms a shape similar to "U" figure, and produced to fit to the shape of maxilla teeth. However, it become clear by the intensive studies of the inventors that the use of above mentioned mouth piece which is fitted only to the shape of maxilla teeth can effectively prevent the breaking of jaw bone or bursting of soft oral cavity and improve a static muscles power like as back muscles power, but an effective improvement on dynamic muscles power during a match or game can not be recognized.

SUMMARY OF THE INVENTION

On the contrary, the inventors have conducted intensive studies on improvement of shape of mouth piece, and consequently found out that the using of the mouth piece forming a cross sectional shape of "H" figure which fits both maxilla teeth and mandibular teeth gives a good result not only on static muscles power but also on dynamic muscles power. And, the inventors have accomplished the present invention and the object of the invention is to provide a newly developed mouth piece which fits both dental arch of maxilla teeth and mandibular teeth.

That is, the prototype of mouth piece of this invention is characterized as follows: A prototype of mouth piece having "H" shaped cross sectional view, which is composed of an intermediate web member outer wall and inner wall and can be loosely installed to dental arch of both maxilla teeth and mandibular teeth.

DETAILED DESCRIPTION OF THE INVENTION

The subject matter of this invention is the prototype of mouth piece having "H" shape cross sectional view, which is composed of an intermediate web member, outer wall and inner wall and can be loosely installed to dental arch of both maxilla teeth and mandibular teeth.

That is, the prototype of mouth piece of this invention is characterized as the product having "H" shaped cross sectional view which can be installed to dental arch of maxilla teeth and mandibular teeth composed by one solid body. And, to the space formed by upper part of this prototype comprised of upper surface of intermediate web member, outer wall and inner wall (hereafter described as upper groove) and the space formed by lower surface of intermediate web member, outer wall and inner wall (hereafter described as lower groove) impression material of room temperature hardening silicon rubber is plugged up. After clenched by user's teeth, the silicon rubber is hardened so as to form one solid body. Thus the mouth piece of this invention is produced.

Figure 1:
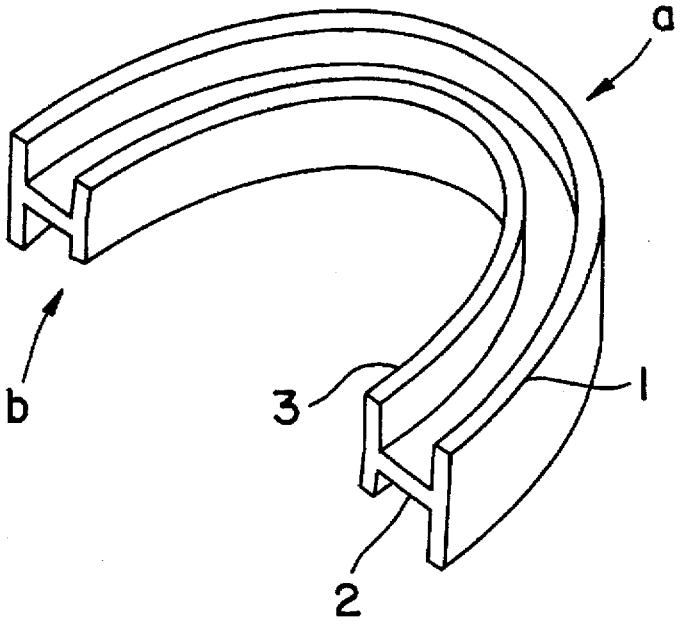
FIG. 1 is a perspective view of the prototype of mouth piece of the present invention.
Figure 2:
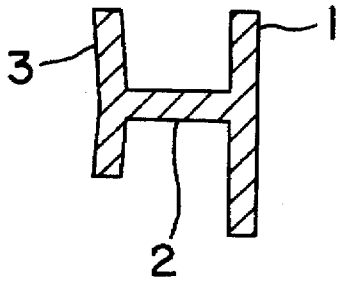
FIG. 2 is a cross sectional view of FIG. 1.

The prototype of mouth piece of this invention is further illustrated by the drawings. FIG. 1 is a perspective view of the prototype of mouth piece, and FIG. 2 is a cross sectional view of FIG. 1. In the drawings, "a" indicates the part of front teeth and "b" indicates the part of molars, and is respectively composed by outer wall 1, intermediate web member 2 and inner wall 3. The outer wall and the inner wall are respectively extended from maxilla teeth to mandibular teeth and form one solid body of "H" figure.

Dimension of the prototype is roughly shown in Table. 1.

TABLE 1

| | front teeth part | molars part |
|---|---|---|
| height of inner wall | 3.5–8.0 mm | 7.0–10.0 mm |
| width between outer wall and inner wall | 8.0–12.0 mm | 9.0–13.0 mm |
| height of outer wall | 5.0–15.0 mm | 10.0–15.0 mm |
| thickness of intermediate web member | 0.5–2.0 mm | 1.0–3.0 mm |

Thickness of the outer and inner wall is about 0.5–2 mm (thickness is variable according to the kind of sports), and the thickness of front teeth part and molars part must be equal.

As the raw material of prototype of mouth piece of this invention silicon rubber is desirable to be used, and as the impression materials which is filled up in the upper and lower groove room temperature hardening silicon rubber is desirable to be used because the adhesive strength between the prototype is strong. But the raw material of prototype is not limited to silicon rubber, and thermo plastic resins such as EVA, polyethylene and polyvinylidenechrolide can be used.

As aforementioned, the prototype of mouth piece of this invention has "H" shaped cross sectional view and the impression materials are plugged up into upper and lower groove, and the mouth piece by using said prototype is adjusted to the respective pattern of theb user's dental arch, therefore, the following excellent effects can be expected to the mouth piece.

1) As this mouth piece is comfortably adapted to user's dental arch, the user can use it without feeling incompatibility. And even if the user feels incompatibility, it can be easily corrected by handy tool because it is made of silicon rubber.

2) This mouth piece can effectively protect maxilla teeth and mandibular teeth. (The mouth piece of this invention can reduce the impact to 1/7 level)

3) As this mouth piece is comfortably fitted to maxilla teeth and mandibular teeth, an increase of dynamic muscle power which concerning whole body sport is recognized, and consequently instantaneous exercise power of the user is strengthened. And, compared with a case of without mouth piece the time to reach maximum instantaneous exercise power is shortened to ½ level.

4) Referring to respiratory and circulatory function, reducing of amount of oxygen taking in is not observed at lower heart rate than 170 beat/min, and in this case a player feels a subjective symptoms of stifling but not cause an oxygen deficit symptom, because oxygen supply to the player's body is sufficient during actual sport play.

What is claim is:

1. A protective mouthpiece formed in a dental arch and comprising an outer wall, an inner wall and an intermediate web member therebetween, said mouthpiece having an "H" shape cross section defining an upper groove capable of receiving maxillary teeth and a lower groove capable of receiving mandibular teeth, wherein the portions of said inner and outer walls defining said upper groove are substantially equal in height and the portion of said inner wall defining said lower groove is shorter than the portion of said outer wall defining said lower groove, whereby said mouthpiece provides protection for maxillary and mandibular teeth without stifling of oxygen intake.

2. The mouthpiece of claim 1 wherein the portion of said inner wall defining said lower groove is one half the height of the portion of said outer wall defining said lower groove.

3. The mouthpiece of claim 1 further comprising an impression material in said upper and lower grooves.

4. The mouthpiece of claim 3 wherein said impression material is a room temperature hardening silicon rubber.

5. The mouthpiece of claim 1 formed from silicon rubber.

6. The mouthpiece of claim 1 formed from moldable thermoplastic resin.

7. The mouthpiece of claim 1 wherein said inner wall has a height of from about 3.5 mm to about 10.0 mm and said outer wall has a height of from about 5.0 mm to about 15.0 mm.

8. The mouthpiece of claim 7 wherein said inner wall has a height of from 3.5 to 8.0 mm in the region of the dental arch corresponding to front teeth and a height of 7.0 to 10.0 mm in the regions of the dental arch corresponding to molars, and wherein said outer wall has a height of 5.0 to 15.0 mm in the region of the dental arch corresponding to front teeth and a height of 10.0 to 15.0 mm in the region of the dental arch corresponding to molars.

* * * * *